US006822199B2

(12) United States Patent
Boyer

(10) Patent No.: US 6,822,199 B2
(45) Date of Patent: Nov. 23, 2004

(54) AUTOMATIC TEMPERATURE CONVERSION SYSTEM FOR CONVECTION COOKING APPLIANCE

(75) Inventor: Mark A. Boyer, Harrison, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/410,406

(22) Filed: Apr. 10, 2003

(65) Prior Publication Data

US 2004/0200822 A1 Oct. 14, 2004

(51) Int. Cl.[7] ..... H05B 1/02; A21B 1/40

(52) U.S. Cl. ..... 219/400; 219/412; 219/413; 219/489; 219/506

(58) Field of Search ..... 219/400, 412, 219/413, 489, 490, 492, 494, 506

(56) References Cited

U.S. PATENT DOCUMENTS 5,756,970 A * 5/1998 Barger et al. ..... 219/506
5,990,454 A * 11/1999 Westerberg et al. ..... 219/492
6,005,229 A * 12/1999 Brown et al. ..... 219/412
6,060,701 A 5/2000 McKee et al.
6,252,206 B1 * 6/2001 Leukhardt et al. ..... 219/486
6,262,406 B1 7/2001 McKee et al.
6,734,403 B2 * 5/2004 Baker et al. ..... 219/486

* cited by examiner

*Primary Examiner*—Joseph Pelham
(74) *Attorney, Agent, or Firm*—Diederiks & Whitelaw, PLC

(57) ABSTRACT

A cooking appliance employing rapid cook technology includes a controller which automatically converts conventional cooking temperatures input by a user to rapid cooking temperatures. In accordance with the most preferred form of the invention, after a user enters a standard radiant cooking temperature into a control panel, an electronic controller subtracts a certain amount, preferably 25° F. (approximately 14° C.), off of the standard temperature. This reduced temperature is then shown in a display provided in the control panel. The controller will use this temperature as the actual cook temperature for the cycle. However, in order to assure food quality, this method is only employed in relatively short convection cooking cycles, such as a convection bake mode.

12 Claims, 2 Drawing Sheets

BAKE ELEMENT
BROIL ELEMENT
FAN
CONVECT HEATING ELEMENT
CPU
TEMPERATURE CONVERSION CIRCUIT
TEMP SENSORS
FAN SPEED SENSOR
UPPER OVEN
LOWER OVEN
CANCEL
Convect Bake
Clean
Broil
More Options
Oven Light
Help
Favorites
Setup
Back
Space
Lock
Enter
TIMER1 On/Off
TIMER2 On/Off
12:00

AUTOMATIC TEMPERATURE CONVERSION SYSTEM FOR CONVECTION COOKING APPLIANCE

BACKGROUND OF THE INVENTION

1. Field of the Invention

The present invention pertains to the art of cooking appliances and, more particularly, to a system for automatically determining a required cooking temperature for a convection oven based on a user inputted temperature for a conventional cooking process.

2. Discussion of the Prior Art

The art of cooking is currently undergoing substantial change. It is no longer the norm to have a family member home all day with time to cook and prepare meals. Today, more and more consumers must rush home from work to prepare meals for themselves or for their families. In today's fast paced society, time is of the essence. The luxury of spending time in preparing a meal is becoming less and less affordable. As such, consumers demand an oven that will cook a meal in less time than conventional ovens, without sacrificing the quality of the prepared food. In order to meet these demands, manufacturers are combining conventional radiant cooking systems with the rapid cook advantages of convection, microwave, and other types of cooking systems.

However, the problem with designing an oven capable of rapidly and effectively cooking a food item is exacerbated by the wide array of consumer tastes. No single cooking process lends itself to efficiently cook the wide variety of food items desired by consumers. For example, while conventional radiant cooking is suitable to a wide assortment of food types, the overall cooking process, especially baking, can be quite slow. The pre-heat time, combined with the cook time, is longer than most businesses or consumers desire.

Microwave ovens, on the other hand, are capable of performing a rapid cooking operation. Unfortunately, the types of food items and cooking processes found to be suitable for microwave cooking are limited. For instance, microwaves, by themselves, are often not suitable for baking or for preparing food items which require a crunchy texture. Yet another method of rapidly cooking a food item is through forced air convection. Forced air convection allows for cooking at lower temperatures as compared to conventional radiant cooking processes. The forced air streams serve to disrupt a thermal insulation layer about the food item which increases the heat transfer rate between the food item and its surroundings.

It is considered that a design incorporating a forced air convection system capable of performing both convection and standard radiant bake cooking can enable an appetizing meal to be prepared in a short time period. The prior art has many examples of ovens which combine several types of cooking processes. However, most are limited in the types of cooking processes performed. In addition, since the use of the convection cooking reduces the overall cook time, consideration has to given to establishing a suitable cooking temperature. That is, regardless of the fact that rapid cook systems are becoming more well known, available recipes generally only provide cooking temperature information based on conventional radiant cooking. This fact places a burden on the user to calculate a necessary oven cavity temperature for convection cooking based on the conventional cook temperature provided, a situation which is certainly less than ideal.

To address this concern, it has been proposed in the art of rapid cooking systems to employ an automatic temperature conversion arrangement. In such an arrangement, a controller of a rapid cooking appliance would automatically deduct a certain temperature value from a user set temperature. That is, the controller would assume that the user is inputting a temperature based on a conventional cooking operation and automatically alters the temperature to establish a rapid cook temperature. Most often, the temperature deviation utilized is fixed and consistently applied. However, the temperature change can vary based on selected food groups.

Although this arrangement works well in connection with cooking various foods, the system is not considered to work well when universally applied in the manner set forth in accordance with the known prior art. Accordingly, based on at least these reasons, there still exists a need in the art for a rapid cooking appliance adapted to automatically compensate for necessary differences between an inputted conventional cook temperature and a rapid cook temperature, at least under appropriate circumstances, to effectively perform a variety of cooking processes for a wide range of foods.

SUMMARY OF THE INVENTION

The present invention is directed to a cooking appliance including both conventional radiant cooking techniques and rapid cook technology, preferably a cooking appliance employing both radiant and convection cooking systems. More specifically, the invention is directed to automatically converting conventional cooking temperatures to rapid cooking modes. The preferred form of the invention concerns a combination radiant and convection cooking appliance incorporating a controller which allows a user to enter standard cooking temperatures for convection cooking without the need to calculate a separate convection cook temperature. That is, the cooking appliance of the invention calculates a reduced convection temperature from the standard cooking temperature entered.

In accordance with the most preferred form of the invention, after a user enters a standard radiant cooking temperature into a control panel, an electronic controller subtracts 25° F. (approximately 14° C.) off of the standard temperature. This reduced temperature is then shown in a display provided in the control panel. The controller will use this temperature as the actual cook temperature for the cycle. However, in order to assure food quality, this method is only employed in relatively short convection cooking cycles, such as a convection bake mode.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
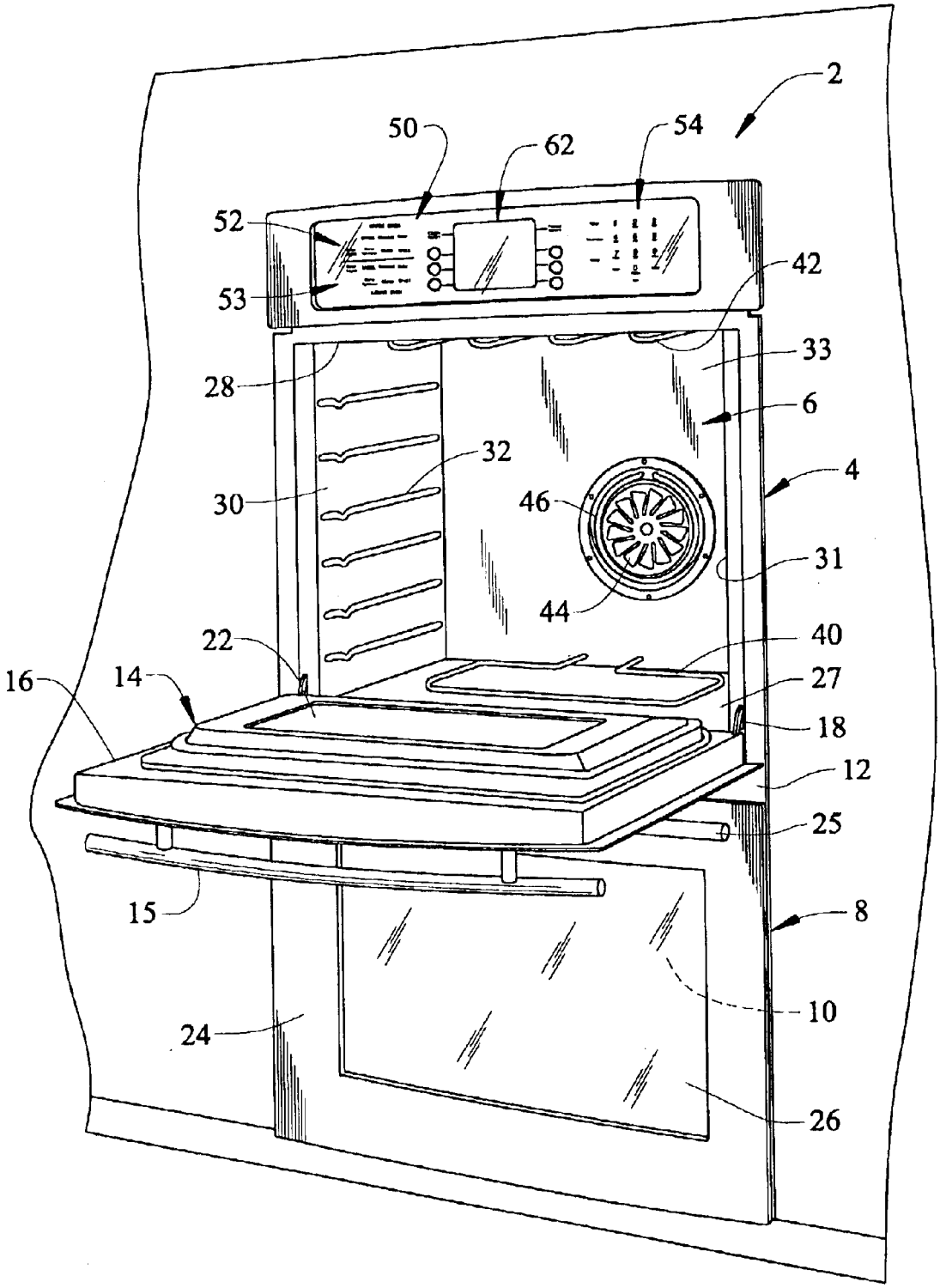
FIG. 1 is a perspective view of a wall oven constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention is not limited to this model type and can be incorporated into various types of oven configurations, e.g., cabinet mounted ovens, as well as both slide-in and free standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 includes an outer frame 12 for supporting both upper and lower oven cavities 6 and 10.

In a manner known in the art, a door assembly 14 is provided to selectively provide access to upper oven cavity 6. As shown, door assembly 14 includes a handle 15 at an upper portion 16 thereof. Door assembly 14 is adapted to pivot at a lower portion 18 to enable selective access to within oven cavity 6. In a manner also known in the art, door 14 is provided with a transparent zone or window 22 for viewing the contents of oven cavity 6 while door 14 is closed. A corresponding door assembly 24 including a handle 25 and a transparent zone or window 26 is provided to selectively access lower oven cavity 10.

As best seen in FIG. 1, oven cavity 6 is defined by a bottom wall 27, an upper wall 28, opposing side walls 30 and 31 provided with a plurality of vertically spaced side rails 32, and a rear wall 33. In the preferred embodiment shown, bottom wall 27 is constituted by a flat, smooth surface designed to improve the cleanability of oven cavity 6. Arranged about bottom wall 27 of oven cavity 6 is a bake element 40. Also, a top broiler element 42 is arranged along upper wall 28 of oven cavity 6. Top broiler element 42 is provided to enable a consumer to perform a grilling process in upper oven 4 and to aid in pyrolytic heating during a self-clean operation. In the preferred form of the invention shown, both bake element 40 and top broiler element 42 are constituted by sheathed electric resistive heating elements.

Based on the above, in the preferred embodiment depicted, cooking appliance 2 actually constitutes an electric, dual wall oven. However, it is to be understood that cooking appliance 2 could equally operate on gas, either natural or propane. In any case, both oven cavities 6 and 10 preferably employ both radiant and convection heating techniques for cooking food items therein. To this end, rear wall 33 is shown to include a convection fan or blower 44. Although the exact position and construction of fan 44 can readily vary in accordance with the invention, in accordance with the most preferred form of the invention, fan 44 draws in air at a central intake zone (not separately labeled) and directs the air into oven cavity 6 in a radial outward direction. Also as clearly shown in this figure, another sheathed electric heating element 46, which preferably takes the general form of a ring, extends circumferentially about fan 44 in order to heat the radially expelled air flow. At this point, it should be noted that a fan cover, which has not been shown for the sake of clarity of the drawings, extends about fan 44 and heating element 46, preferably with the cover having an associated central inlet opening and a plurality of outer radial outlets openings.

Figure 2:
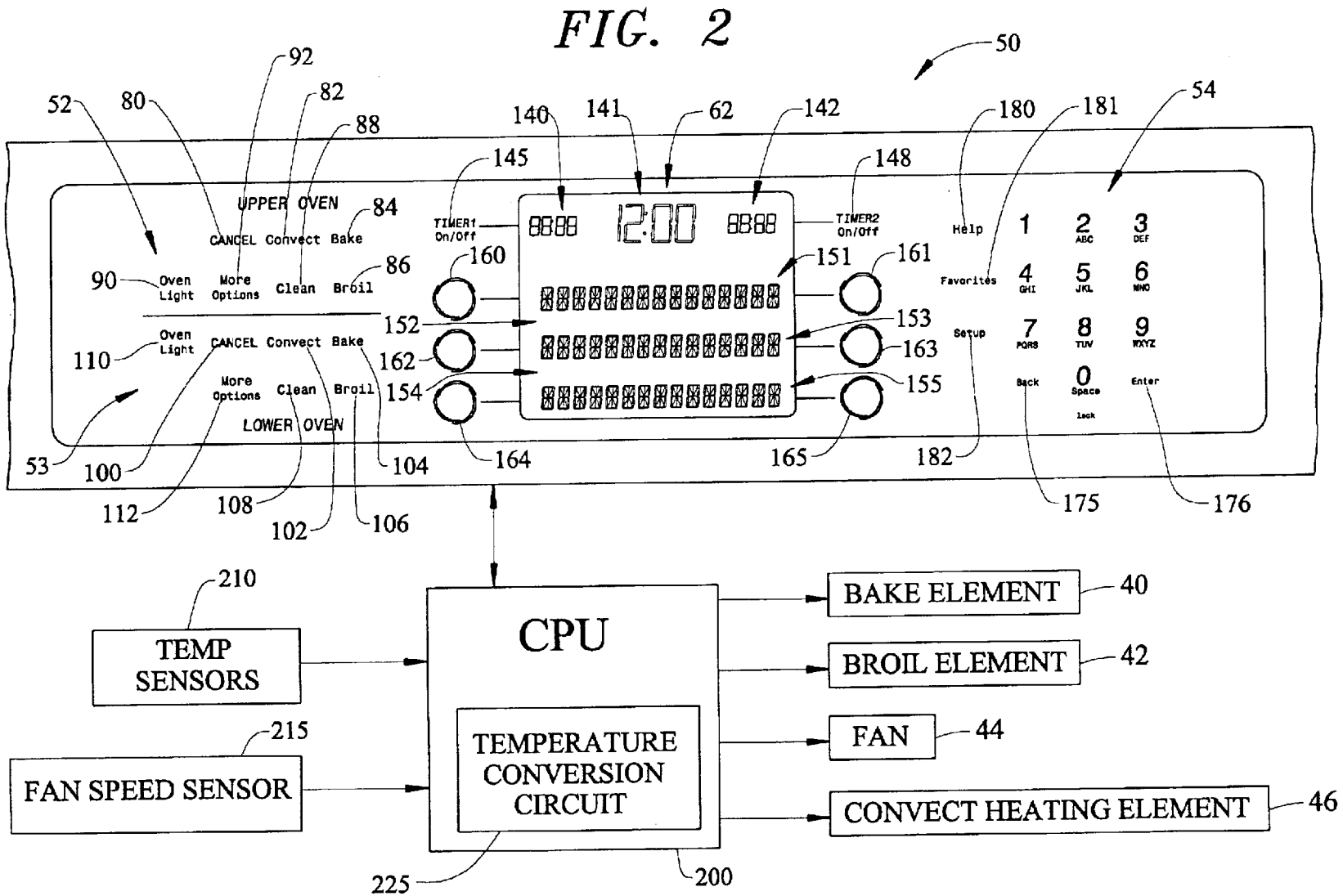
FIG. 2 is an enlarged view of a control panel and system employed in connection with the wall oven of FIG. 1.

As further shown in FIGS. 1 and 2, cooking appliance 2 includes an upper control panel 50 having a plurality of control elements. In accordance with one embodiment, the control elements are constituted by first and second sets of oven control buttons 52 and 53, as well as a numeric pad 54. Control panel 50 is adapted to be used to input desired cooking parameters for cooking appliance 2. More specifically, the first and second sets of control buttons 52 and 53, in combination with numeric pad 54 and a display 62, enable a user to establish particular cooking operations for upper and lower ovens 4 and 8 respectively.

In the preferred embodiment particularly shown in FIG. 2, first set of control buttons 52 includes a cancel button 80, a convection button 82, a bake button 84, a broil button 86, and a clean button 88. In addition, first set of control buttons 52 also preferably includes an oven light button 90 and a button 92 used to access more cooking options which are conveyed to the user through display 62. In a corresponding manner, second set of control buttons 52 includes a cancel button 100, a convection button 102, a bake button 104, a broil button 106, and a clean button 108. Furthermore, second set of control buttons 53 also preferably includes an oven light button 110 and a button 112 which is used to access more cooking options that are conveyed to the user through display 62.

To this end, display 62 is preferably divided into various sections. In accordance with the most preferred embodiment of the invention, an uppermost section of display 62 is sub-divided into three time display zones 140–142. More specifically, leftmost display zone 140 constitutes a first timer zone having an associated timer button 145. Central display zone 141 constitutes a clock for cooking appliance 2. Rightmost display zone 142 constitutes a second timer zone having an associated timer button 148.

Spaced below time display zones 140–142 are a series of vertically spaced information display zones 151–155. Each of information display zones 151, 153 and 155 has associated left and right portions (not separately labeled). As will be detailed more fully hereinafter, each of the left and right portions have associated therewith laterally positioned selection buttons 160–165.

As shown, numeric pad 54 preferably enables alphanumeric input. That is, in addition to presenting numbers 0–9, numeric pad 54 doubles as an input source for alpha information. To this end, the number 2 button functions for ABC letter entry; the number 3 button functions for DEF letter entry; the number 4 button functions for GHI letter entry; the number 5 button functions for JKL letter entry; the number 6 button functions for MNO letter entry; the number 7 button functions for PQRS letter entry; the number 8 button functions for TUV letter entry; and the number 9 button functions for WXYZ letter entry. The number 0 button can also be used to input a space. On either side of the number 0 button are Back and Enter buttons 175 and 176 which can be used in combination with the various alpha keys for information entry. Finally, provided adjacent numeric pad 54 are Help, Favorites and Setup buttons 180–182.

In general, control panel 50 is linked to a controller or CPU 200 formed as part of cooking appliance 2. Therefore, CPU 200 receives user inputs and selections through control panel 50, as well as signals from sensors associated with cooking appliance 2, i.e. oven temperature sensors for upper and lower ovens 4 and 8 as generally indicated at 210 and a blower speed sensor 215. In turn, CPU 200 controls bake element 40, top broiler element 42, convection fan 44, and convection heating element 46.

Since general programming aspects employed by a user of cooking appliance 2 does not form part of the present invention, these features will not be discussed further here. Instead, the present invention is particularly directed to the incorporation and operation of a temperature conversion circuit 225 in connection with CPU 200. More specifically, in accordance with the invention, temperature conversion circuit 225 functions to take a standard cooking temperature entered by a user through control panel 50 and automatically calculates a reduced convection temperature from the standard cooking temperature entered.

In a preferred form of the invention, after a user selects a desired convection cooking operation through either of the first and second rows of control buttons 52, 53, the user is prompted to enter a standard radiant cooking temperature through numeric pad 54. If the cook time is less than a predetermined amount, preferably less than or equal to one hour, temperature conversion circuit 225 automatically subtracts a certain amount off of the standard temperature. Therefore, temperature conversion circuit 225 determines if the inputted cook time is less than a predetermined amount of time and, if so, the automatic temperature reduction function is performed. This reduced temperature is then shown in a display 62, such as in display zone 153. The CPU 200 uses this adjusted temperature as the actual cook temperature for the convection cooking operation.

Although the exact amount subtracted from the inputted, standard temperature can vary, in accordance with the most preferred form of the invention, temperature conversion circuit 225 subtracts 25% to establish the actual cook temperature. However, in order to assure food quality, this method is only employed in relatively short convection cooking cycles. That is, for long cooking times, generally in the order of greater than 1 hour, temperature conversion circuit 225 will not alter the user set temperature. However, during shorter cook periods, such as a convection bake mode of operation, the cook temperature is significantly reduced, i.e., preferably by the 25° F. (approximately 14° C.), while still not negatively affecting the quality of the food being cooked.

Although described with reference to a preferred embodiment of the invention, it should be readily understood that various changes and/or modifications can be made to the invention without departing from the spirit thereof. In general, the invention is only intended to be limited by the scope of the following claims.

I claim:

1. A cooking appliance comprising:

an oven cavity;

at least one radiant heating element arranged for producing radiant heat in the oven cavity;

a rapid cook heating source;

a control panel for both selecting a desired cooking operation for the oven cavity and inputting a cooking temperature for the desired cooking operation;

temperature conversion means for automatically establishing an actual cook temperature which is equal to a reduced amount of the cooking temperature, only if the cooking time is less than a predetermined amount; and means for controlling the at least one radiant heating element and the rapid cook heat source in dependence on the desired cooking operation and the actual cook temperature.

2. The cooking appliance according to claim 1, wherein the rapid cook heating source comprises:

a fan for developing a convection air flow within the oven cavity; and a convection heating element for heating the air flow.

3. The cooking appliance according to claim 2, wherein said establishing means reduces the cooking temperature by 25° F. (approximately 14° C.) to set the actual cook temperature.

4. The cooking appliance according to claim 3, wherein the predetermined amount is less than or equal to one hour.

5. The cooking appliance according to claim 1, further comprising: means for displaying the actual cook temperature.

6. A cooking appliance comprising:

an oven cavity;

at least one radiant heating element arranged for producing radiant heat in the oven cavity;

a fan for developing a convection air flow within the oven cavity;

a convection heating element for heating the air flow;

a control panel for both selecting a desired cooking operation for the oven cavity, setting a desired cooking time, and inputting a cooking temperature for the desired cooking operation;

means for establishing an actual cook temperature based on the cooking temperature, with said actual cook temperature being set equal to the cooking temperature if the cooking time is less than a predetermined amount and automatically set equal to a reduced amount of the cooking temperature if the cooking time is less than the predetermined amount; and means for controlling the at least one radiant heating element, the fan and the convection heating element in dependence on the desired cooking operation and the actual cook temperature.

7. The cooking appliance according to claim 6, wherein said establishing means reduces the cooking temperature by 25° F. (approximately 14° C.) to set the actual cook temperature.

8. The cooking appliance according to claim 7, wherein the predetermined amount is less than or equal to one hour.

9. The cooking appliance according to claim 6, further comprising: means for displaying the actual cook temperature.

10. In a cooking appliance including an oven cavity adapted to be heating by both a radiant heating source and a rapid cook heating source, a method of establishing parameters of a cooking operation comprising:

inputting a desired cooking operation;

inputting a cooking time;

setting a cooking temperature;

determining if the cooking time is less than a predetermined amount;

setting an actual cook temperature, which includes automatically reducing the cooking temperature only if the cooking time is determined to be less than the predetermined amount; and performing the desired cooking operation for the actual cook temperature.

11. The method of claim 10, wherein the cooking temperature is automatically reduced by 25° F. (approximately 14° C.).

12. The method of claim 10, further comprising: displaying the actual cook temperature.

* * * * *